US007434275B1

(12) United States Patent
DeVore et al.

(10) Patent No.: US 7,434,275 B1
(45) Date of Patent: Oct. 14, 2008

(54) APPARATUS FOR SELECTIVELY PREVENTING FLUSHING OF A TOILET

(76) Inventors: Gregory DeVore, 855 Greenridge Dr., La Canada, CA (US) 91011; Steven DeVore, 1627 N. Mountain Oaks, Orem, UT (US) 84097

( * ) Notice: Subject to any disclaimer, the term of this patent is extended or adjusted under 35 U.S.C. 154(b) by 587 days.

(21) Appl. No.: 11/137,873

(22) Filed: May 26, 2005

(51) Int. Cl.
*E03D 5/00* (2006.01)

(52) U.S. Cl. ..... 4/405; 4/378; 4/415

(58) Field of Classification Search ..... 4/415, 4/353, 378, 405, 412; 137/410
See application file for complete search history.

(56) References Cited

U.S. PATENT DOCUMENTS 3,095,577 A 7/1963 Clark
3,296,630 A 1/1967 Clark
3,358,294 A 12/1967 Nolan et al.
3,719,957 A 3/1973 Riedel
4,117,556 A 10/1978 Semler
4,319,368 A 3/1982 Peters
4,351,071 A 9/1982 Clar
4,356,576 A 11/1982 Gala
4,433,445 A 2/1984 Morris et al.
4,485,501 A 12/1984 Kloner
5,117,513 A 6/1992 Burrowes
5,459,884 A 10/1995 Wesolowsky
5,544,368 A 8/1996 Wang
5,752,281 A * 5/1998 Conner ..... 4/415 X

* cited by examiner

*Primary Examiner*—Robert M Fetsuga
(74) *Attorney, Agent, or Firm*—Thomas R. Lampe

(57) ABSTRACT

Apparatus for selectively preventing flushing of a toilet includes a flush handle mounted on the tank of the toilet and structure in the tank interior for engaging a float of the water inlet valve control assembly of the toilet when the flush handle is actuated. A lock on the flush handle is employed to lock the float in an elevated condition to prevent the flow of flush water into the tank.

3 Claims, 5 Drawing Sheets

APPARATUS FOR SELECTIVELY PREVENTING FLUSHING OF A TOILET

TECHNICAL FIELD

This invention relates to flush toilets and more particularly to apparatus for preventing standard flush mechanism in a toilet tank from being operated. Suitably, for example, the invention can be employed to prevent the flush mechanism from being operated when there is a clogged toilet bowl to avoid overflow.

BACKGROUND OF THE INVENTION

A clogged toilet bowl or drain lines associated with a toilet can result in overflow from the toilet bowl when the toilet is flushed. Needless to say, overflow, when it occurs, is aggravating, messy and unsanitary.

As will be seen below, the apparatus disclosed and claimed herein positively prevents flushing of a toilet when desired. The flush mechanism of the toilet is deactivated through use of a lock disposed externally of the toilet tank, the flush handle being prevented from operation by the lock. When the handle is locked against movement, flush mechanism within the toilet tank is engaged to prevent lowering of a float associated with the flush water inlet valve control assembly so that water cannot enter the tank. The apparatus may be utilized with flush systems employing either lever arm floats or slide floats and the apparatus may readily be configured for utilization with different flush mechanisms.

The following patents are considered representative of the current state of the prior art in this field. U.S. Pat. No. 5,117,513, U.S. Pat. No. 4,433,445, U.S. Pat. No. 5,544,368, U.S. Pat. No. 4,485,501, U.S. Pat. No. 5,459,884, U.S. Pat. No. 4,356,576, U.S. Pat. No. 3,719,957, U.S. Pat. No. 4,351,071, U.S. Pat. No. 3,095,577, U.S. Pat. No. 3,296,630, and U.S. Pat. No. 4,117,556. Most of the patents relate to mechanisms which allow adjustment of the amount of water flushed. U.S. Pat. Nos. 3,358,294 and 4,319,368 relate to latches or locks which cooperate with existing toilet flush levers to prevent flushing of a toilet, for example by an infant. These devices are employed as adjuncts to the existing toilet handles and do not cooperate directly in any manner with the internal flush mechanism of the toilet, in the manner of the subject invention which ensures that water will not enter the toilet tank through the flush water inlet valve.

DISCLOSURE OF INVENTION

The present invention relates to apparatus for selectively preventing flushing of a toilet having a toilet tank and flush mechanism including a flush water inlet valve control assembly having a float in the toilet tank.

The apparatus includes a handle moveably mounted on the toilet tank.

Flush mechanism engagement structure is located in the toilet tank and connected to the handle, being moveable within the toilet tank from a first condition to a second condition responsive to movement of the handle.

The flush mechanism engagement structure when in the second condition engages the flush mechanism to prevent downward movement of the float whereby flush water is prevented from entering the toilet tank.

A lock is employed for selectively locking the flush mechanism engagement structure in the second condition.

In the illustrated embodiment of the invention, the handle comprises a toilet flush handle moveable between a first position to a second position. The lock is operatively associated with and incorporated in the flush handle to selectively prevent movement of the flush handle from the second position and simultaneously maintain the flush mechanism engagement structure in the second condition.

Other features, advantages and objects of the present invention will become apparent with reference to the following description and accompanying drawings.

BEST MODE FOR CARRYING OUT THE INVENTION

Figure 4:
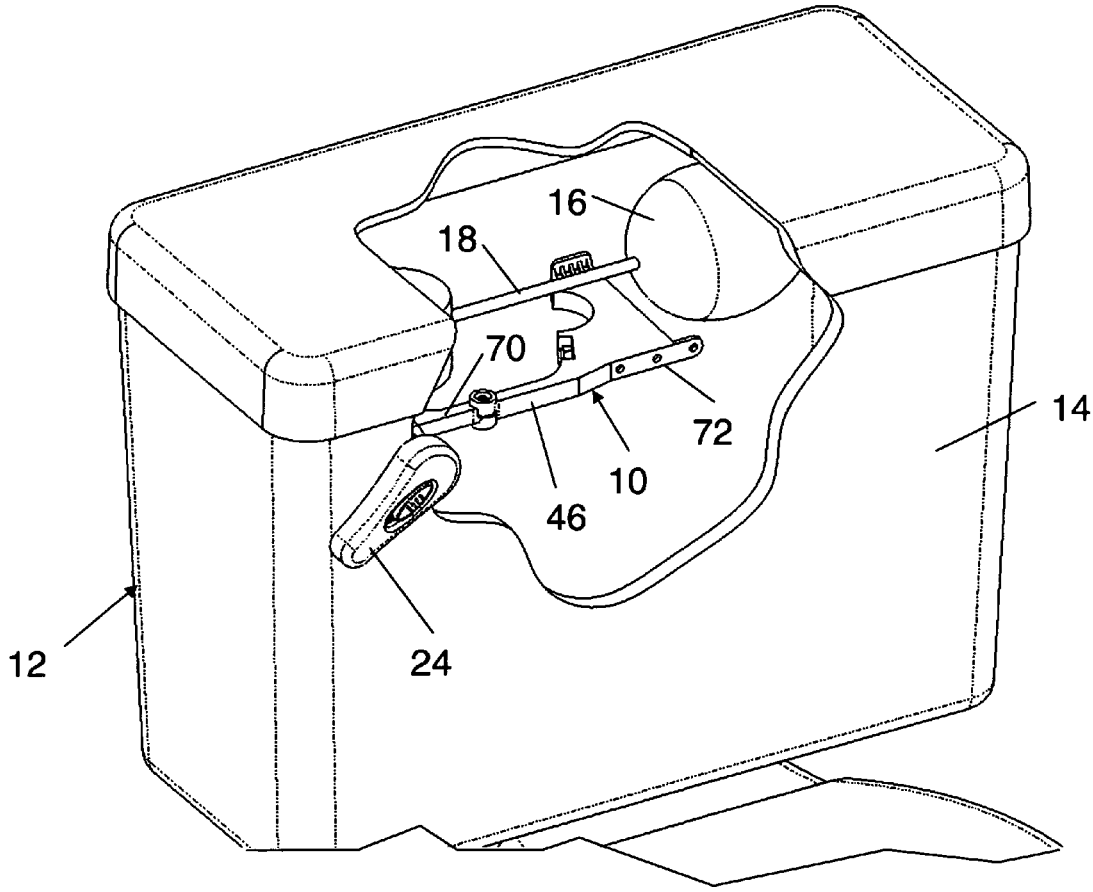
FIG. 4 illustrates the apparatus mounted on a toilet, a portion of the toilet tank and tank cover broken away to show the apparatus employed in association with a lever arm float of the toilet.

Referring now to the drawings, apparatus constructed in accordance with the teachings of the present invention is designated by reference numeral 10. In FIG. 4 the apparatus is shown installed on a conventional toilet 12 having a toilet tank 14 and flush mechanism including a flush water inlet valve control assembly (only partially illustrated) having a float 16 disposed at the end of a lever arm 18 comprising part of the flush water inlet valve control assembly. The complete assembly is of well known conventional structure and has not been illustrated.

Figure 5:
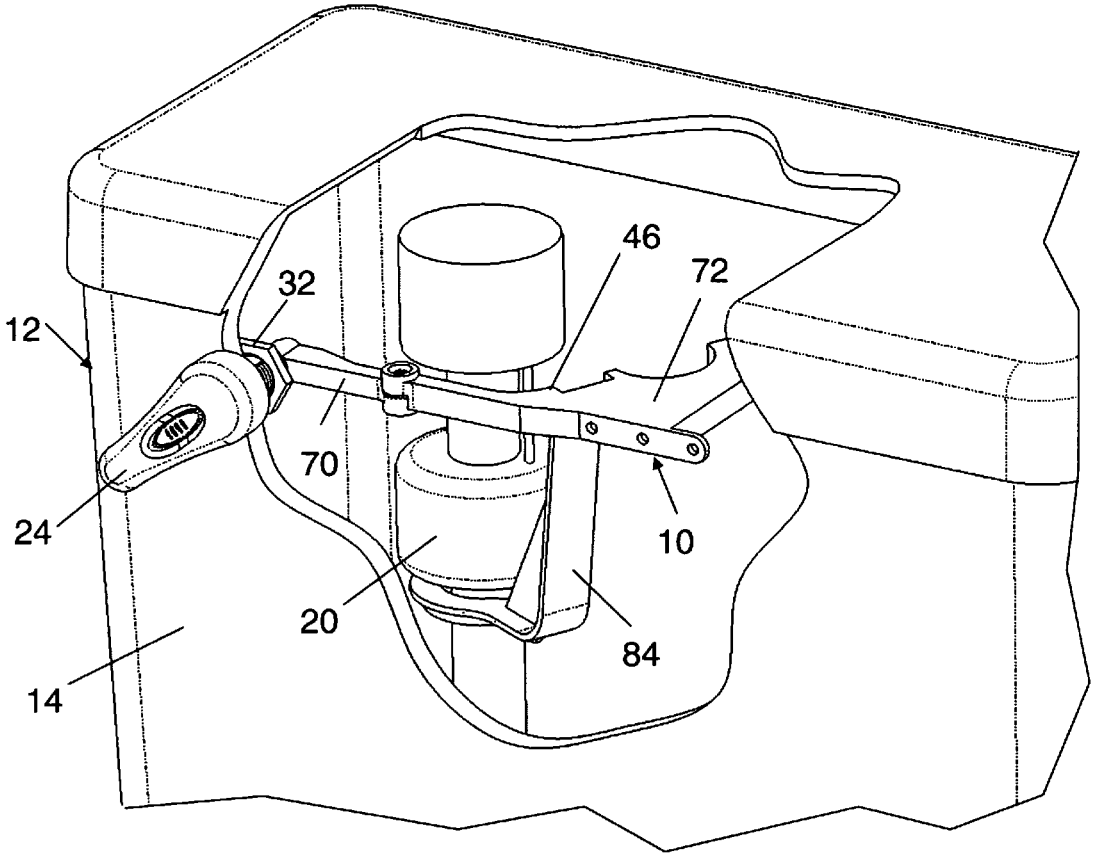
FIG. 5 is a perspective view of the apparatus connected to a toilet incorporating a slide valve float, portions of the tank and tank cover broken away.

In FIG. 5, the apparatus 10 is in the tank 14 of a conventional toilet employing a slide float 20 of the flush water inlet valve control assembly, such an arrangement also being of a well known conventional nature and not fully illustrated.

The apparatus includes a toilet flush handle 24 rotatably mounted on the toilet tank. The handle differs from conventional flush handles, as will be described below, and replaces a previously installed handle if the apparatus is being retrofit to an existing toilet. Of course, the apparatus could also be installed as original equipment in a new toilet.

Handle 24 includes an inwardly directed boss 26 which has a circular-shaped outer periphery, the boss 26 extending into a throughbore 28 of a shaft 30. The inner end of the shaft 30 has outer threads as shown. The shaft 30 passes through the tank wall and is threadedly secured in position by a nut 32 within the tank.

Figure 1:
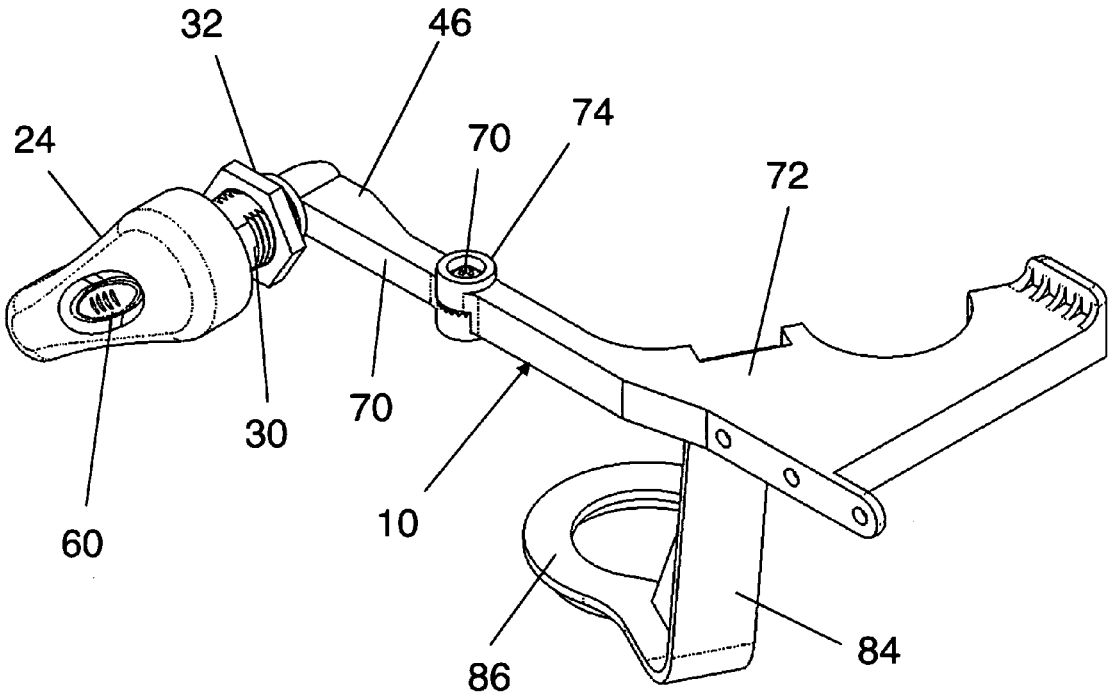
FIG. 1 is a front, perspective view of apparatus constructed in accordance with the teachings of the present invention.
Figure 2:
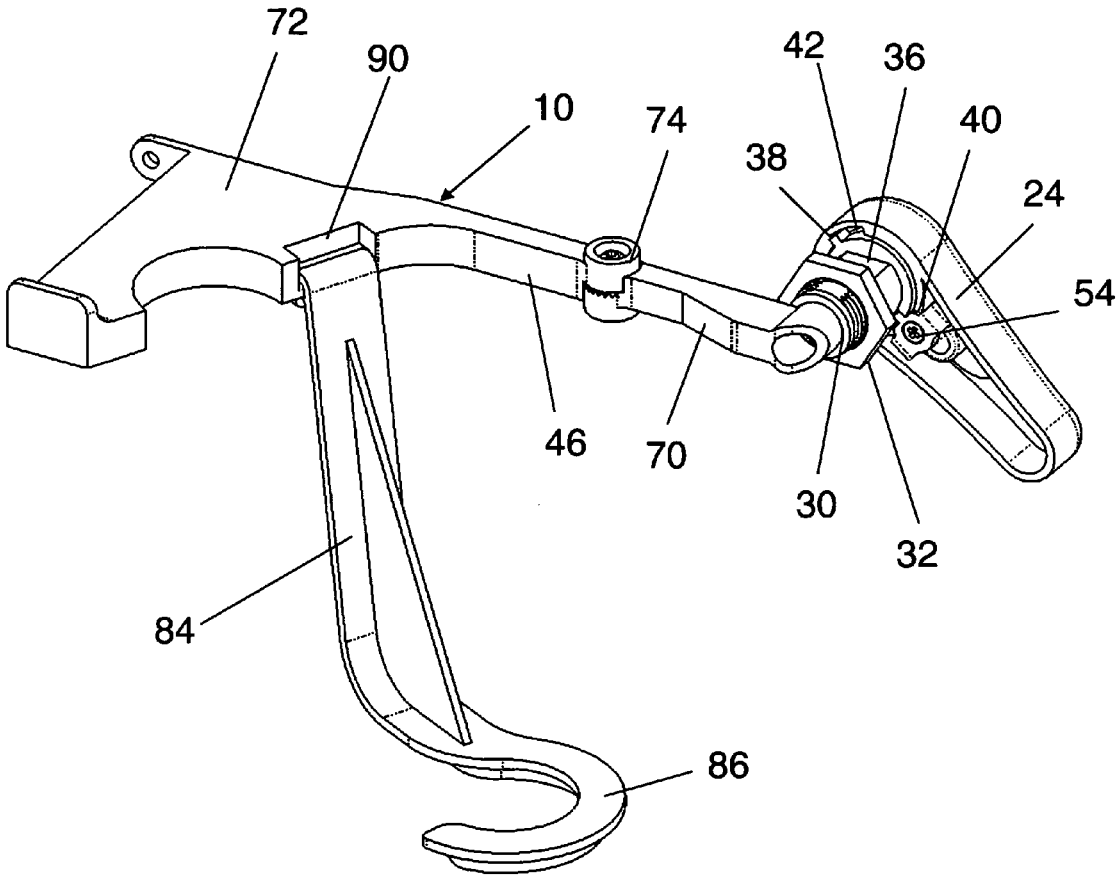
FIG. 2 is a rear, perspective view of the apparatus.
Figure 3:
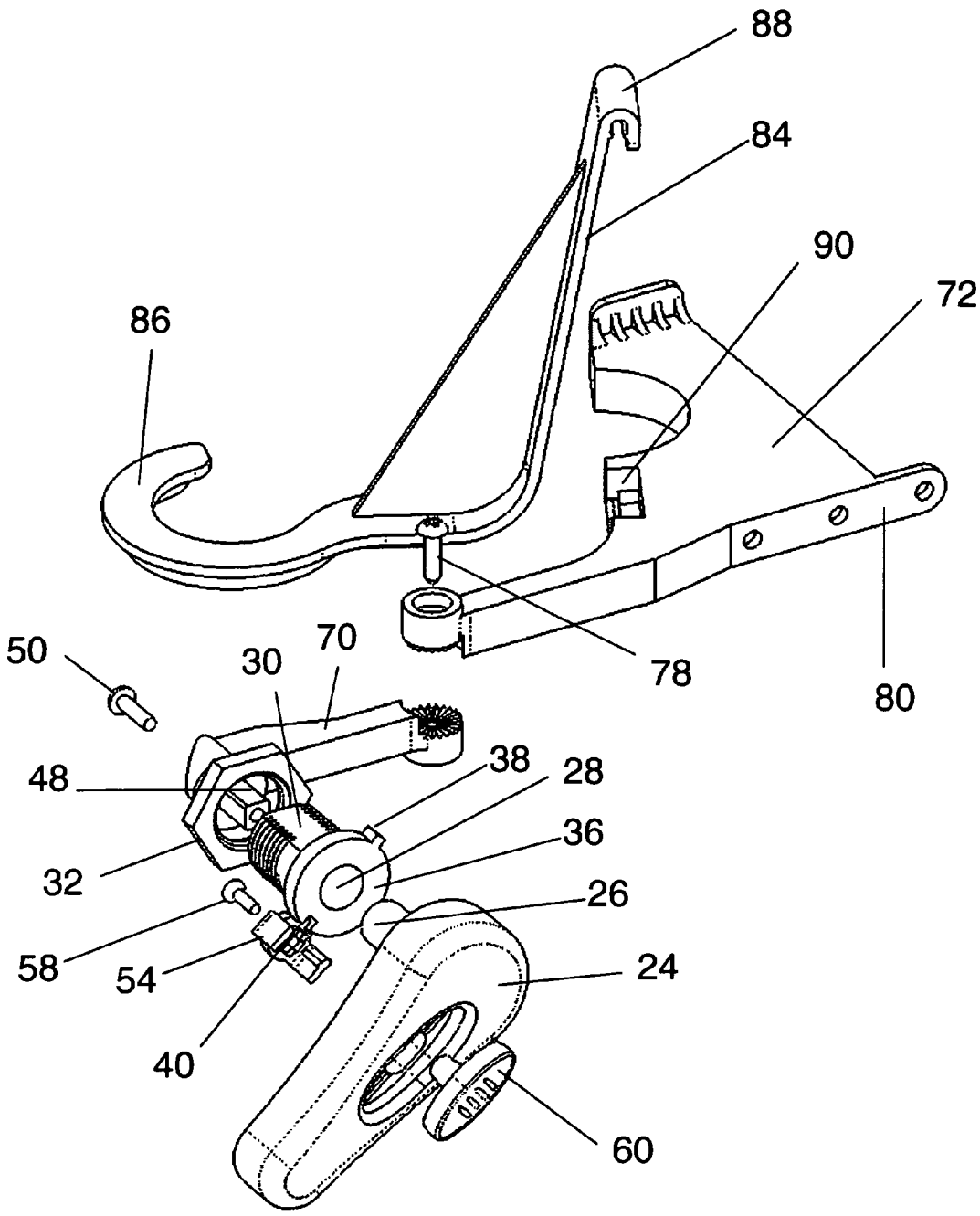
FIG. 3 is an exploded, perspective view of the apparatus.

A flange 36 is located at the outwardly directed end of the shaft 30. A projection 38 projects from the outer periphery of the flange at a selected location thereon and a notch 40 is formed in the flange at a location spaced from the projection. The flange fits into a correspondingly shaped recess formed at the back of the handle (see FIG. 2) with the projection 38 moveable in an arcuate-shaped recess portion 42. The amount of rotational movement of the flush handle relative to the shaft 30 is determined by the length of the arcuate-shaped recess portion.

Located in the tank 14 is flush mechanism engagement structure comprising an elongated structural member 46 attached by suitable means to the handle whereby rotation of the handle will cause corresponding rotation of the elongated structural member. In the illustrated arrangement, a boss 48 having a throughbore therein is integrally formed with the structural member 46 and projects into throughbore 28 and into engagement with boss 26 of the handle. A fastener such as a screw 50 passes through boss 48 and is threadedly secured to the boss 26 to establish an interconnection therebetween.

Rotation of the flush handle will therefore cause corresponding rotation of the flush mechanism engagement structure within the tank of the toilet. Counterclockwise movement of the flush handle (as viewed from the front of the tank) from a first position to a second position, the latter corresponding to the flush position, will cause counterclockwise rotation of the elongated structural member 46 within the tank.

In FIG. 4 the structural member 46 is located under lever arm 18 and will engage the lever arm when the handle is rotated as shown in FIG. 4. This will prevent the float 16 from moving downwardly and the flush mechanism will be deactivated. Flush water will be prevented from entering the toilet tank due to the normal action of the conventional flush water inlet valve control assembly.

A lock is incorporated in the apparatus for selectively locking the flush mechanism engagement structure in the condition shown in FIG. 4. For purposes of this application, this condition or positioning of the flush mechanism engagement structure will be referred to as the second condition, the first condition being the condition or location of the flush mechanism engagement structure when the structural member 46 is disposed below and out of engagement with the lever arm.

The lock employed to lock the handle in its second position while simultaneously maintaining the flush mechanism engagement structure in its second condition is in the form of two relatively moveable lock members. One lock member is the flange 36 at the end of the shaft 30 and the other lock member is a slide lock including detent 54 which is manually slid alternatively into or out of notch 40 of the flange. The slide lock is connected to the handle 24 by a screw 58 and a slide button 60 on the handle is utilized to selectively slide the detent 54 into the notch 40 or out of the notch.

The elongated structural member 46 has two relatively moveable segments 70, 72 interconnected by a locking hinge 74. The locking hinge 74 includes separable upper and lower hinge components having matingly engageable teeth, each hinge component attached to a segment of the structural member. A threaded fastener such as screw 78 is utilized to allow angular adjustment between the two structural member segments to change the configuration of the elongated structural member to adapt to different configurations and types of flush mechanisms and tank sizes.

In the arrangement illustrated, the upper surface of the outer structural member segment 72 in addition to being the structural member portion directly engageable with the flush water inlet valve control assembly has attached thereto a chain connector 80 defining holes for connecting a flush water outlet valve chain to the structural member so that the apparatus acts in a conventional manner to flush the toilet when the handle is not locked against rotation.

The apparatus is also readily adaptable for use with flush mechanisms employing slide valves to control the entry of water into the tank. In the arrangement illustrated, this is accomplished by a slide valve float engagement element 84 which is releasably connected to and selectively removable from the remainder of the structure. In the illustrated embodiment, slide valve float engagement element 84 is generally L-shaped and has a lower distal end 86 which is positioned under the slide float 20, as shown in FIG. 5, and prevents downward movement of the slide valve when the handle is locked in the position shown in FIG. 5. A hook 88 at the upper end of the slide valve float engagement element 84 extends through a slot 90 formed in structural member segment 72 to releasably connect the element 84 to the structural member segment 72. In FIG. 4 the slide valve float engagement element 84 has been disconnected and removed.

The invention claimed is:

1. Apparatus for attachment to a toilet for selectively preventing flushing of the toilet, the toilet having a toilet tank and flush mechanism including a flush water inlet valve control assembly having a float in said toilet tank comprising either a lever arm float or a slide float, said apparatus comprising, in combination:

a toilet flush handle for mounting on the toilet tank and for rotatable movement relative to the toilet tank when mounted thereon between a first position and a second position;

flush mechanism engagement structure for positioning in said toilet tank connected to said toilet flush handle for joint rotation therewith and rotatably movable within said toilet tank when positioned in the toilet tank from a first condition to a second condition upon rotatable movement of said toilet flush handle, said flush mechanism engagement structure when in said second condition for engaging said flush mechanism to prevent downward movement of said float whereby flush water is prevented from entering said toilet tank;

a lock for selectively locking said flush mechanism engagement structure in said second condition, said lock selectively preventing movement of said toilet flush handle from said second position and simultaneously maintain said flush mechanism engagement structure in said second condition, said lock including two relatively moveable lock members, one of said lock members having a detent and the other of said lock members defining an indent for releasably receiving said detent to selectively prevent rotation of said toilet flush handle when said toilet flush handle is in said second position and said flush mechanism engagement structure is in said second condition, one of said lock members mounted on said toilet flush handle, said flush mechanism engagement structure comprising a structural member attached to said toilet flush handle for rotation therewith and including a structural member portion for direct engagement with the flush water inlet valve control assembly when said apparatus is attached to the toilet to maintain said float in an elevated condition when said flush handle is locked against rotatable movement by said lock, said structural member including at least two relatively moveable segments hingedly connected by a hinge enabling the structure member portion to move in a generally horizontal plane and the configuration of said structural member and the position of said structural member portion to be varied; and locking structure connected to said hinge to selectively lock said segments against pivotal movement relative to one another about said hinge, said structural member portion including a slide valve float engagement element for directly engaging a slide float.

2. The apparatus according to claim 1 wherein said structural member includes a chain connector for connecting a flush water outlet valve chain to said structural member.

3. The apparatus according to claim 1 wherein said slide float engagement element is releasably connected to and removable from the remainder of said structural member portion.

* * * * *